United States Patent [19]

James

[11] Patent Number: 4,499,397

[45] Date of Patent: Feb. 12, 1985

[54] COLOR CORRECTIVE COATING FOR ARC LAMP

[75] Inventor: William G. James, Cleveland Heights, Ohio

[73] Assignee: General Electric Company, Schenectady, N.Y.

[21] Appl. No.: 439,519

[22] Filed: Nov. 5, 1982

[51] Int. Cl.[3] ..... H01J 5/16; H01J 61/40; H01K 1/32

[52] U.S. Cl. ..... 313/112; 313/635

[58] Field of Search ..... 313/110, 112, 116, 635, 313/17, 25

[56] References Cited

U.S. PATENT DOCUMENTS

| | | | |
|---|---|---|---|
| 2,806,968 | 9/1957 | Thorington et al. | 313/112 X |
| 2,966,605 | 12/1960 | Harris et al. | 313/112 X |
| 3,892,997 | 7/1975 | Thorington et al. | 313/112 X |
| 4,081,709 | 3/1978 | Collins et al. | 313/116 |
| 4,091,951 | 5/1978 | Zijlstra et al. | 313/635 X |
| 4,393,331 | 7/1983 | Dobrusskin et al. | 313/112 X |

*Primary Examiner*—David K. Moore

*Attorney, Agent, or Firm*—John P. McMahon; Philip L. Schlamp; Fred Jacob

[57] ABSTRACT

An arc lamp having a coating comprised of an inorganic yellow pigment plus white pigments located on the inner surface of its outer glass envelope is disclosed. The coating is a color corrective diffuse type which improves the color rendition of the lamp by altering the portion of visible light radiation of the blue spectrum relative to that of the yellow portion of the light spectrum.

4 Claims, 2 Drawing Figures

COLOR CORRECTIVE COATING FOR ARC LAMP

BACKGROUND OF THE INVENTION

This invention relates to an arc lamp having a coating on the inside surface of its outer bulb, and more particularly, to a corrective coating placed on the inside surface of the outer envelope of the arc lamp which enhances the warm tones, that is, that in which there is a desired increase in the yellow rendition relation to the blue rendition.

In the prior art it has been known to dispose coatings of inorganic oxide on the lamp envelope to serve various purposes. For example, the U.S. Pat. No. 4,081,709 of C. B. Collins, and myself W. G. James, proves a light-diffusion coating placed on the inner walls of an incandescent lamp by electrostatic deposition.

In the arc tube art there is a need to improve the color rendition of the lamp. It is desired that an arc tube have a color rendition so as to allow a spectral distribution which approaches that of an incandescent lamp having a tungsten type filament. The color rendition of the arc tube has a predominance of a blue-type light emission. The blue-type light emission is not desirable for the arc tube lamp in that the desired color rendition is of a warmer type.

Accordingly, it is an object of the present invention to provide means such as a color correction which lowers the blue-type emission relative to the yellow-type emission so as to provide a more pleasing spectral distribution of the arc tube lamp which is one more nearly having the appearance of a filament source.

These and other objects of the present invention will become more apparent upon consideration of the following description of the invention.

SUMMARY OF THE INVENTION

This invention is directed to an arc tube lamp having a color corrective coating on its inner surface which improves the color rendition of the arc tube lamp by altering the proportion of blue spectrum of the lamp to a desired greater proportion of the yellow spectrum rendition for the arc tube lamp.

Accordingly in one embodiment of the present invention, an arc tube lamp comprising a quartz tube, mercury vapor, other metallic vapors, and means to produce an electrical discharge within the glass tube is provided. The arc tube has an enclosing glass bulb, which has a corrective color coating on its inner surface. The corrective color coating comprises a mix of electrostatic silica powders and a yellow pigment.

The color corrective coating alters the source color point of a MacAdam type color plot of the arc tube lamp from approximately $x=0.4$, $y=0.365$, and CCT=3400° C. to approximately $x=0.435$, $y=0.405$ and CCT=3000° C. which is a color point acceptably near to that of a incandescent lamp having a tungsten type filament.

DESCRIPTION OF THE PREFERRED EMBODIMENT

Figure 1:
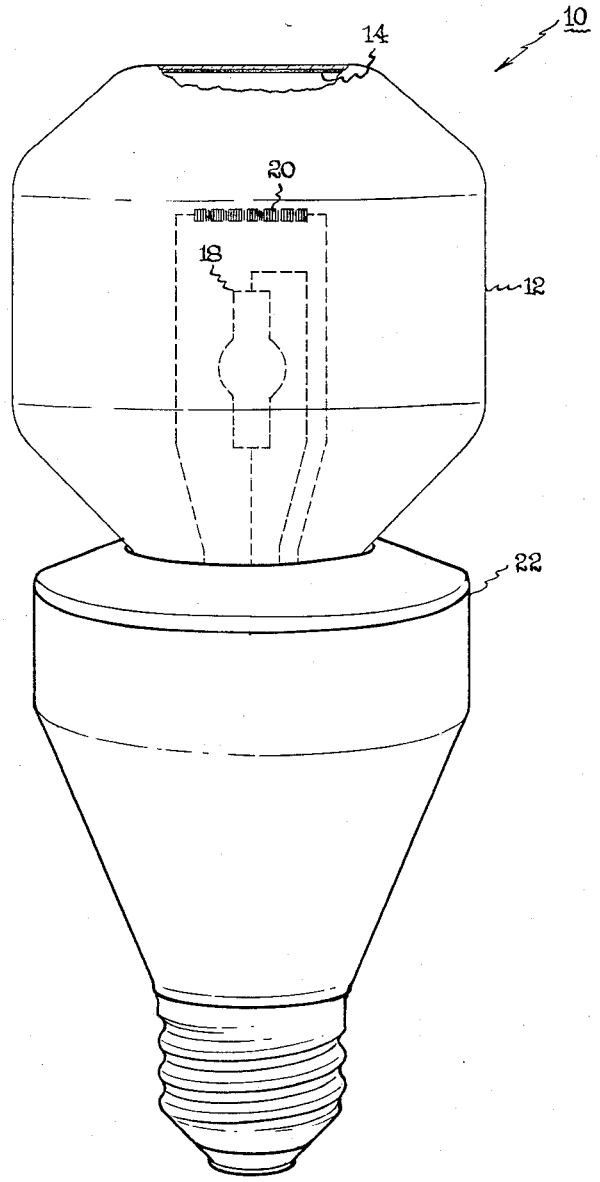
FIG. 1 is a perspective view of the arc tube lamp, partially broken away to show the inner coating of the present invention.

FIG. 1 shows the arc tube lamp 10 of the present invention. FIG. 1 shows the arc tube lamp 10 as including a quartz type arc tube light source 18 shown in phantom containing a mercury vapor or other metallic vapors, a tungsten filament light source 20 also shown in phantom, means (not shown in FIG. 1) to produce an electrical discharge which may be positioned within housing 22, and an outer envelope 12 having placed on its inner surface a corrective coating of the present invention.

According to the present invention I provide the color corrective coating 14 consisting of a mix of electrostatic silica blend and a yellow pigment. It is desired that the corrective coating 14 be such as to remain inert under lamp fabrication processing, and under lamp operation conditions. The color corrective coating 14 provides a means for altering the spectral distribution of the arc tube lamp 10 so as to enhance the yellow/blue ratio.

In one embodiment of the present invention, the coating 14 is formed by mixing electrostatic silica blend with a titanium yellow pigment having portions by weight within the ranges of 95 to 99 and 5 to 1 respectively. The electrostatic silica blend may be of the types described in the aforementioned U.S. Pat. No. 4,081,079 and the U.S. patent application Ser. No. 328,040, now U.S. Pat. No. 4,441,047 both assigned to same assignee of the present invention and both herein incorporated by reference.

The yellow oxide pigment may be of the type Pigment Yellow 53 (77788) which is commercially available from Drakenfeld Division, Ciba Geigy, Inc., of Washington, Pa., 15301, or Ferro Corp., 4150 E. 56th Street, Cleveland, Ohio 44105.

In another embodiment of my invention, the coating 14 is formed by mixing electrostatic silica blend, which may be of the types previously mentioned and described in the U.S. Pat. No. 4,081,079 and U.S. patent application Ser. No. 328,040, with a cadmium sulfide (CdS) pigment, Pigment Yellow 37(77199) having proportions by weight within the ranges of 99.95 to 99.75 and 0.05 to 0.25 respectively.

Figure 2:
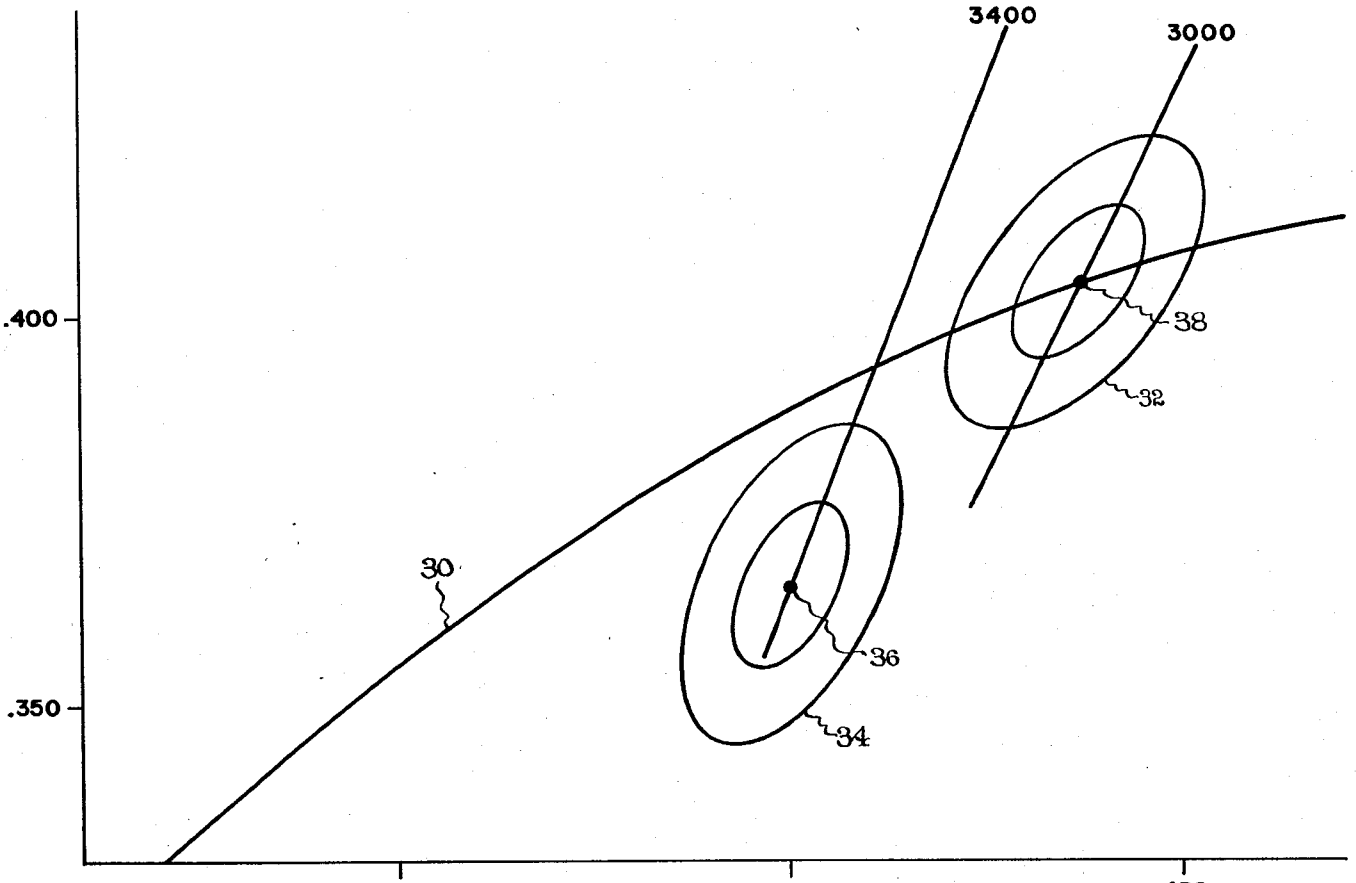
FIG. 2 is a plot showing the color point of the arc tube lamp on the black body line having been altered by the present invention.

The powdered mix of the silica blend and yellow pigment may preferably be placed onto the inner surface of the outer envelope of the arc tube 10 of FIG. 1 by using an electrostatic coating process such as described in U.S. Pat. No. 4,081,709 and to which reference may be made for further details. The desired color rendition of the lamp 10 of FIG. 1 is shown by the plot of FIG. 2. FIG. 2 is a MacAdam type color plot showing an ideal black body line 30, and various oval shaped regions 32 and 34 intersected by correlated color temperatures (CCT) 3000° K. and 3400° respectively. The MacAdam type color plot is well-known in the lamp art as described in a typical lamp art literature, such as Color Science, Chapters 1 and 6, page 53 and 529, respectively, by Wyszecki and Stiles published by John Wiley and Son and copyrighted in 1967.

The oval shaped region 32 of FIG. 2 represents the confines of the color point of a typical tungsten type filament light source of an incandescent lamp, whereas, the oval shaped region 34 of FIG. 2 represents the confines of the color point of a typical multi-vapor light source of an arc tube. FIG. 2 shows the altering of the typical arc type light source from the region 34 below the black body line 30 to the region 32 which is on and surrounds the portion of the black body line 30. This alteration is accomplished by the pigments of the present invention. More particularly, the pigments of the present invention alter the color point of arc lamp 10 from a position 36 below the black body to a position 38 located on the black body line 30.

The white and yellow pigments forming the layer 14 of FIG. 1 shift the source color point of the MacAdams plot of FIG. 2 from region 34 having the coordinates x=0.4, y=0.365 and CCT=3400 (shown as position 36) to the region 32 having coordinates x=0.435, y=0.405 and CCT=3000° C. (shown as position 38). It should be recognized that these coordinates of positions 36 and 38 are approximate values.

The result of the information shown in FIG. 2 alters the source color point of the arc discharge lamp 10 of FIG. 1, so as to lessen the blue emission normally emitted by an arc discharge lamp and proportionally increase the yellow portion of the visible spectrum. The overall effect of the layer 14 of my present invention providing the color correction which lowers the blue-type emission relative to the yellow-type emission spectrum is to substantially give the arc discharge lamp 10 a more pleasing spectral distribution having the appearance of an incandescent lamp of a typical tungsten incandescent light source.

What I claim and desire to be secured by Letters Patent of the United States is:

1. An arc lamp having an inner envelope of a quartz type arc tube containing a mercury vapor or other metallic vapors, an inner tungsten filament light source, means to produce an electrical discharge, and an outer envelope having a color corrective coating on its inner surface; said color corrective coating effective for shifting the color point on a MacAdam type color plot of an arc tube lamp from approximately x=0.4, y=0.365 and CCT=3400° C. to approximately x=0.435, y=0.405 and CCT=3000° C., which is substantially a color point of an incandescent lamp having a tungsten type filament, wherein said color corrective coating comprises:

a mix of electrostatic silica blend and a yellow oxide pigment.

2. An arc lamp having an inner envelope of a quartz type arc tube containing a mercury vapor or other metallic vapors, an inner tungsten filament light source, means to produce an electrical discharge, and an outer envelope having a color corrective coating on its inner surface; said color corrective coating effective for shifting the color point on a MacAdam type color plot of an arc tube lamp from approximately X=0.4, y=0.365 and CCT=3400° C. to approximately x=0.435, y=0.405 and CCT=3000° C., which is substantially a color point of an incandescent lamp having a tungsten type filament, and said color corrective coating comprises:

a mix of electrostatic silica blend and a cadmium sulfide pigment.

3. An arc lamp according to claim 1 wherein said mix of electrostatic silica blend and yellow oxide pigment has portions by weight within the ranges of 95 to 99 and 5 to 1 respectively.

4. An arc lamp according to claim 2 wherein said mix of electrostatic silica blend and cadmium sulfide pigment has portions by weight within the ranges of 99.95 to 99.75 and 0.05 to 0.25 respectively.

* * * * *